US006281444B1

(12) United States Patent
Yamanashi

(10) Patent No.: US 6,281,444 B1
(45) Date of Patent: Aug. 28, 2001

(54) PROTECTIVE COVER FOR CONNECTOR

(75) Inventor: Makoto Yamanashi, Shizuoka (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/296,665

(22) Filed: Apr. 22, 1999

(30) Foreign Application Priority Data

Apr. 22, 1998 (JP) ..... 10-112226

(51) Int. Cl.[7] ..... H01B 17/00

(52) U.S. Cl. ..... 174/138 F; 439/350; 439/552; D13/147

(58) Field of Search ..... 174/138 F, 138 R, 174/137 B; 439/350, 552; D13/147

(56) References Cited

U.S. PATENT DOCUMENTS

D. 210,533 * 3/1968 Pauza ..... 174/138 F
D. 308,513 * 6/1990 Endo et al. ..... D13/147
D. 335,649 * 5/1993 Ogawa ..... D13/147
D. 410,896 * 6/1999 Yotsutani et al. ..... D13/147
3,366,729 * 1/1968 Pauza ..... 174/138 R
5,338,219 * 8/1994 Harimoto et al. ..... 439/350
5,454,737 * 10/1995 Saba ..... 439/350

* cited by examiner

*Primary Examiner*—Dean A. Reichard
*Assistant Examiner*—Adolfo Nino
(74) *Attorney, Agent, or Firm*—Sughrue, Mion, Zinn, Macpeak & Seas, PLLC

(57) ABSTRACT

A protective cover for a connector including a cover body to be fitted over a terminal engaging portion of the connector, an engaging projection provided on the cover body in such a manner as to be capable of engaging an engaging stepped portion formed on the lock arm and of being disengaged from the engaging stepped portion by a tilting operation of the lock arm, and a pair of arm protecting walls provided projectingly on an outer peripheral wall of the cover body in such a manner as to face each other with the lock arm positioned therebetween. The height of an upper edge of each of the arm protecting walls is set in such a manner that the lock arm is accommodated in a space defined by the pair of arm protecting walls.

3 Claims, 7 Drawing Sheets

PROTECTIVE COVER FOR CONNECTOR

BACKGROUND OF THE INVENTION

1. Field of the Invention

The present invention relates to a protective cover for a connector, and more particularly to a protective cover for a connector for protecting a terminal engaging portion of a connector in which a lock arm for retaining a connector engaging portion on a mating side is provided projectingly on an outer peripheral wall of a housing.

2. Description of the Related Art

Conventionally, in a connector used in a wire harness or the like for a vehicle, there is a possibility of dust entering through an opening of a terminal engaging portion formed at a front end of a terminal accommodating chamber during such as storage or transport prior to being engaged with a connector engaging portion on a mating side, possibly resulting in faulty contact. In addition, in the case of a connector in which a lock arm for retaining the connector engaging portion on the mating side is provided projectingly on an outer peripheral wall of a housing, since the lock arm is exposed to the outside, there is a possibility that the lock arm undergoes plastic deformation or a lock projection becomes damaged due to an external force or contact with other equipment.

Accordingly, as shown in FIG. 5, a protective cover 1 for a connector is fitted over a terminal engaging portion 2*a* of a connector 2 so as to prevent dust and protect a lock arm 7.

The connector 2 has a structure in which the lock arm 7, which is formed in such a manner as to project from an outer peripheral wall of a housing 5 for accommodating a plurality of wire-attached terminals 4 in an arranged form, has the following: a flexible arm 7*a* extending rearwardly from a terminal-engaging-portion front end side of the outer peripheral wall via a front upright proximal portion; an engaging projection 7*b* formed on the flexible arm 7*a* and serving as an engaging portion; and a tab portion 7*c* formed on a free end side of the flexible arm 7*a*. The engaging projection 7*b* can be engaged with or disengaged from a retaining means provided in a connector engaging portion or the like on the mating side, through a tilting operation in which the tab portion 7*c* is depressed toward the outer peripheral wall of the housing as indicated by arrow (C) in FIG. 5. Incidentally, in this case, the retaining means provided on the mating connector or the connector engaging portion of an electric or electronic equipment or the like is a recessed portion or a stepped portion capable of retaining the engaging projection 7*b*.

The protective cover 1 is comprised of a substantially box-shaped cover body 8 which is fitted over the front end side of the housing 5 and covers a tip opening of the terminal engaging portion 2*a* of the connector 2, as well as a coupling retaining means 9 which is provided on the cover body 8 in such a manner as to be capable of engaging the engaging projection 7*b* when the cover body 8 is fitted over the housing 5, and of being disengaged from the engaging projection 7*b* by the tilting operation of the flexible arm 7*a*. The coupling retaining means 9 has the same structure as the retaining means provided on the mating connector or the connector engaging portion of an electric or electronic equipment or the like, i.e., a connecting counterpart of the connector 2, and is formed as an engaging groove into which the engaging projection 7*b* plunges when the amount of the housing 5 fitted into the cover body 8 reaches a predetermined amount.

Then, when the protective cover 1 is properly fitted over the front end side of the housing 5, the engaging projection 7*b* on the lock arm 7 of the connector 2 is engaged with the coupling retaining means 9 of the protective cover 1. As a result, the protective cover 1 is set in a state of being held and fixed by the connector 2, and the tip opening of the terminal engaging portion 2*a* of the connector 2 is set in a state of being covered with the protective cover 1.

However, in the above-described protective cover 1, the tab portion 7*c* of the lock arm 7 projects outwardly of the protective cover 1, so that there has been a possibility that if another member or the like strikes against the tab portion 7*c* during storage or the like, the lock arm 7 becomes depressed, which cancels the engagement between the engaging projection 7*b* and the coupling retaining means 9, causing the protective cover 1 to slip off.

In particular, in a case where the connector 2 is a connector for a flexible printed circuit board (FPC) where spring portions of wire-attached terminal are exposed at its terminal engaging portion, such as a connector for a meter of a vehicle, to prevent the deformation of the spring portions the laying operation of the wire harness must be effected with the protective cover 1 fitted thereto until immediately before the engagement with the mating connector engaging portion.

Accordingly, as shown in FIG. 6, in a case where the connector 2 is inserted in a connector insertion hole 11*a* formed in an instrument panel 11, the connector 2 is inserted with the protective cover 1 fitted thereon. However, there is a problem in that, at that juncture, unless the size of the opening of the connector insertion hole 11*a* is sufficiently large, an edge of the connector insertion hole 11*a* can strike on the tab portion 7*c* during the inserting operating, which depresses the lock arm 7, thereby causing the protective cover 1 to fall inside the instrument panel 11.

Accordingly, to prevent the occurrence of such a problem, a protective cover 12 for a connector such as the one shown in FIGS. 7 and 8 has been proposed.

The protective cover 12 is disclosed in Japanese Patent Unexamined Publication No. Hei. 8-273745, and a pair of flexible lock walls 14 for the lock arm 7 are provided projectingly on an inner surface of substantially box-shaped cover body 13 which is fitted over the terminal engaging portion 2*a* of the connector 2. Retaining projections 14*a* which engage a front upright proximal portion of the lock arm 7 rising from the housing 5 are respectively provided on the pair of flexible lock walls 14.

Namely, when the terminal engaging portion 2*a* of the connector 2 is inserted into the protective cover 12, the retaining projections 14*a* on the pair of flexible lock walls 14 engage the back of the front upright proximal portion, and are locked with respect to the connector 2, as shown in FIG. 8. Accordingly, even if the tab portion 7*c* is depressed, the engagement between the engaging projection 14*a* and the lock arm 7 is prevented from becoming canceled and the protective cover 12 is prevented from coming off the connector 2, thereby preventing unintentional coming off of the protective cover 12.

However, with the protective cover 12 shown in FIGS. 7 and 8, the state of engagement between the lock arm 7 and the pair of retaining projections 14*a* cannot be canceled by the tilting operation in which the tab portion 7*c* of the lock arm 7 is depressed. To remove the protective cover 12 from the connector 2, the cover body 13 must be forcibly pulled to thereby resiliently deform the pair of flexible lock walls 14 on the inner sides of the cover body 13.

Accordingly, if the engaging strength of the retaining projections 14*a* is set high so as to prevent the cover body 13 from coming off the connector 2 unintentionally, a force is required for removing the cover body 13, and removal becomes difficult. Hence, there arises the problem that the operating efficiency in the attachment of the protective cover 12 to the connector and the removal thereof from the connector declines as compared with the protective cover 1 shown in FIG. 6. In addition, in the protective cover 12, since the tab portion 7*c* of the lock arm 7 is not protected, the tab portion 7*c* is liable to be caught at the opening edge of the connector insertion hole 11*a* when the connector 2 is inserted into the connector insertion hole 11*a*, so that the operating efficiency in insertion is not satisfactory.

Further, in the case where the cover body 13 itself is provided with finger applying portions 15 which are caught by fingers, as shown in FIG. 7, there is a problem in that the protective cover 12 becomes large in size and bulky. Moreover, since the pair of flexible lock walls 14 which are adapted to undergo resilient deformation must be provided on the inner sides of the cover body 13, there is a problem in that the structure of a mold for the protective cover 12 becomes complex, resulting in higher cost.

SUMMARY OF THE INVENTION

Accordingly, it is an object of the present invention to provide an inexpensive and satisfactory protective cover for a connector which can be easily engaged with or disengaged from a connector and can be reliably prevented from coming off the connector unintentionally, thereby overcoming the above-described problems of the conventional protective covers.

In order to achieve the above object, according to the present invention, there is provided a protective cover for a connector for protecting a terminal engaging portion of the connector in which a lock arm for retaining a connector engaging portion on a mating side is provided projectingly on an outer peripheral wall of a housing, the protective cover comprising: a cover body to be fitted over the terminal engaging portion of the connector; retaining means provided on the cover body in such a manner as to be capable of engaging an engaging portion formed on the lock arm and of being disengaged from the engaging portion by a tilting operation of the lock arm; and a pair of arm protecting walls provided projectingly on an outer peripheral wall of the cover body in such a manner as to face each other with the lock arm positioned therebetween, wherein a height of an upper edge of each of the arm protecting walls is set in such a manner that the lock arm is accommodated in a space defined by the pair of arm protecting walls.

According to the above-described arrangement, when the protective cover is fitted over the connector, the engagement or disengagement between the retaining means on the cover body and the engaging portion on the lock arm can be easily attained by the tilting operation of the lock arm of the connector, and it is unnecessary to forcibly press or pull the protective cover with respect to the connector for the engagement or disengagement. Hence, an advantage can be obtained in that the operating efficiency in fitting and removing the protective cover with respect to the connector does not decline.

In addition, the pair of arm protecting walls provided projectingly on the outer peripheral wall of the cover body project outwardly of the lock arm of the connector over which the protective cover is fitted, and another member or the like is prevented from striking on the lock arm. Therefore, it is possible to prevent a situation where another member or the like strikes on a relevant portion of the lock arm during storage or installing operation of the connector, causing the lock arm to tilt. For this reason, it is possible to reliably prevent the protective cover from coming off the connector unintentionally during storage or installing operation, and it is possible to prevent the permanent set of the lock arm. Further, the lock arm is prevented from becoming caught at an opening edge of a connector insertion hole formed in a panel or the like.

DETAILED DESCRIPTION OF THE PREFERRED EMBODIMENT

Referring now to the accompanying drawing, a detailed description will be given of a protective cover for a connector according to an embodiment of the present invention.

A protective cover 20 for a connector of this embodiment is to be fitted over a terminal engaging portion 21*a* of a connector 21 which is used for wire harness or the like for a vehicle.

Figure 1:
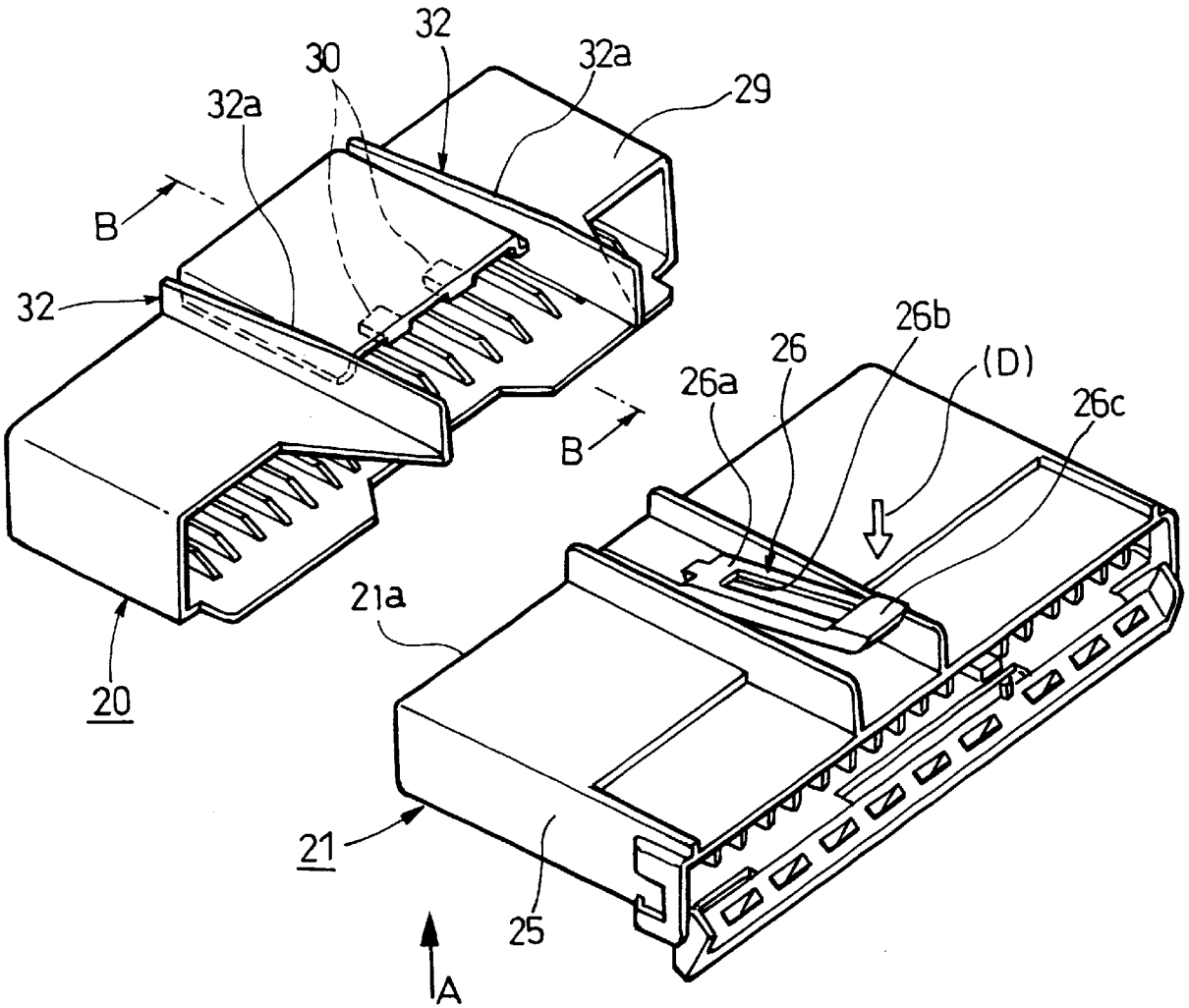
FIG. 1 is an overall perspective view illustrating a state in which a protective cover for a connector according to an embodiment of the present invention is removed from a connector.
Figure 2:
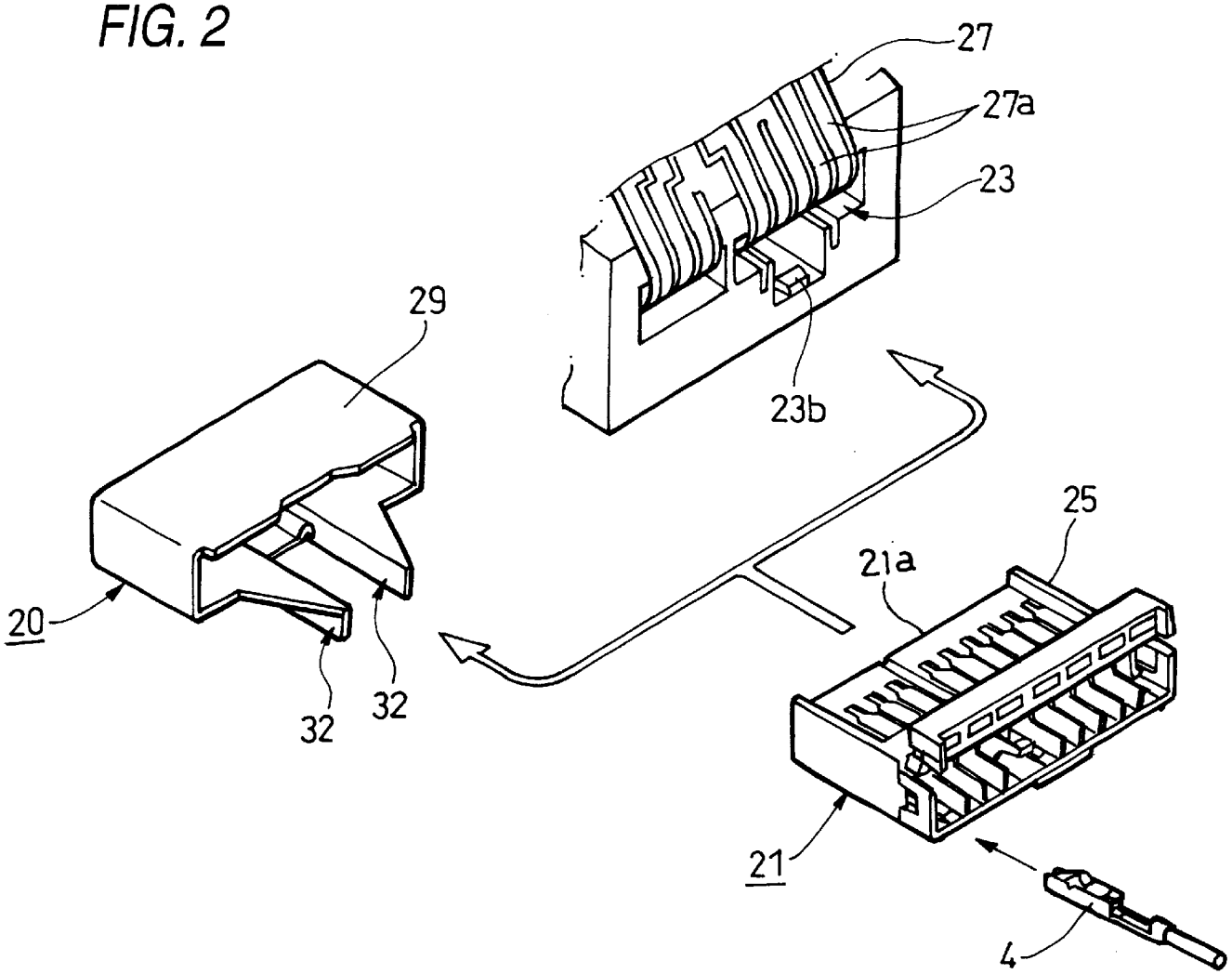
FIG. 2 is an overall perspective view, taken from a lower surface side, of the protective cover and the connector shown in FIG. 1, and a perspective view of an essential portion of a connector engaging portion to which the connector is connected.

As shown in FIG. 2, the connector 21 is to be engaged with and connected to a connector engaging portion 23 in a meter panel which is installed in an instrument panel of a vehicle. The connector 21 has a structure in which a lock arm 26, (FIG. 1) which is formed in such a manner as to project from an outer peripheral wall of a housing 25 for accommodating a plurality of wire-attached terminals 4 in an arranged form, has the following: a flexible arm 26*a* extending rearwardly from a terminal-engaging-portion front end side of the outer peripheral wall via a front upright proximal portion; an engaging stepped portion 26*b* formed on the flexible arm 26*a* and serving as an engaging portion; and a tab portion 26*c* formed on a free end side of the flexible arm 26*a*.

When the connector 21 is engaged with and connected to the connector engaging portion 23, the engaging stepped portion 26*b* formed on the lock arm 26 engages a retaining projection 23*b* serving as a retaining means provided in the connector engaging portion 23.

Accordingly, if the tab portion 26*c* formed on the free end of the flexible arm 26*a* is depressed toward the outer peripheral wall of the housing as indicated by arrow (D) in FIG. 1, a tilting operation occurs in which the flexible arm 26*a* is deflected toward the outer peripheral wall of the housing. If such a tilting operation is effected, the engagement between the retaining projection 23*b* and the engaging stepped portion 26*b* becomes canceled.

As shown in FIG. 2, the connector 21 has a structure in which an outer peripheral wall of the housing 25 on its lower surface side is cut off so that spring portions of the wire-attached terminals 4 accommodated in a terminal accommodating chamber of the housing 25 in an arranged form are exposed in planar form. When the connector 21 is engaged with the connector engaging portion 23, the exposed wire-attached terminals 4 are electrically connected to terminal portions 27*a* on a flexible printed wiring board 27 installed on the side of the connector engaging portion 23.

Figure 3:
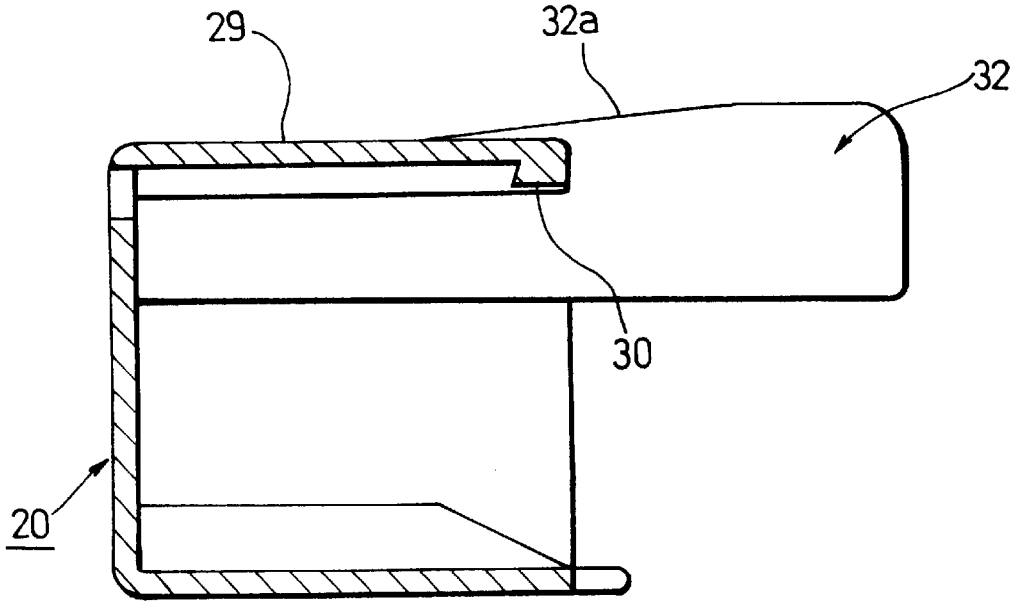
FIG. 3 is a cross-sectional view, taken in the direction of arrows along line B—B in FIG. 1, of the protective cover.

As shown in FIGS. 2 and 3, the protective cover 20 is comprised of a substantially box-shaped cover body 29 which is fitted over the front end side of the housing 25 and covers a tip opening of the terminal engaging portion 21*a* of the connector 21 and the above-described exposed portions of the wire-attached terminals 4, retaining projecting 30, (FIG. 1) which serve as a retaining means and are provided on the cover body 29 in such manner as to be capable of engaging the engaging stepped portion 26*b* when the cover body 29 is fitted over the terminal engaging portion 21*a*, and of being disengaged from the engaging stepped portion 21*b*, and a pair of arm protecting walls 32 provided projectingly on the outer peripheral wall of the cover body 29 in such a manner as to face each other with the lock arm 26 positioned therebetween.

Figure 4:
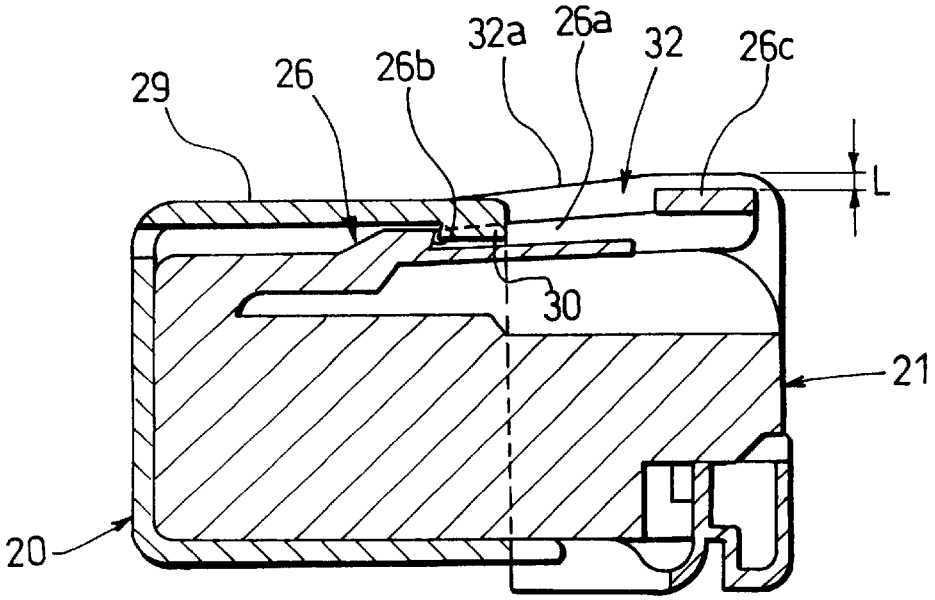
FIG. 4 is a vertical cross-sectional view illustrating a state in which the connector is fitted in the protective cover shown in FIG. 3.
Figure 5:
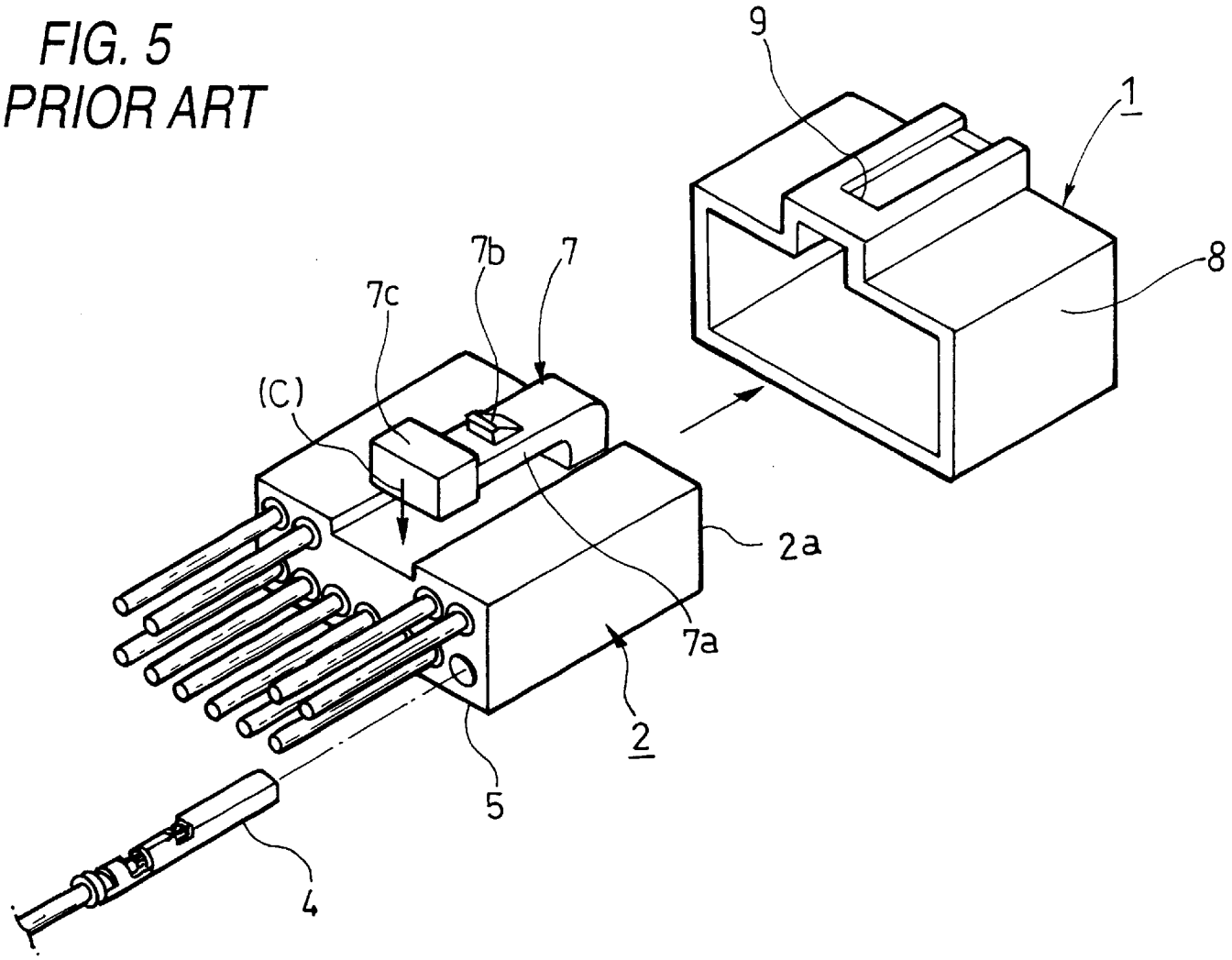
FIG. 5 PRIOR ART
FIG. 5 is an overall perspective view illustrating a state in which a conventional protective cover for a connector is removed from a connector.
Figure 6:
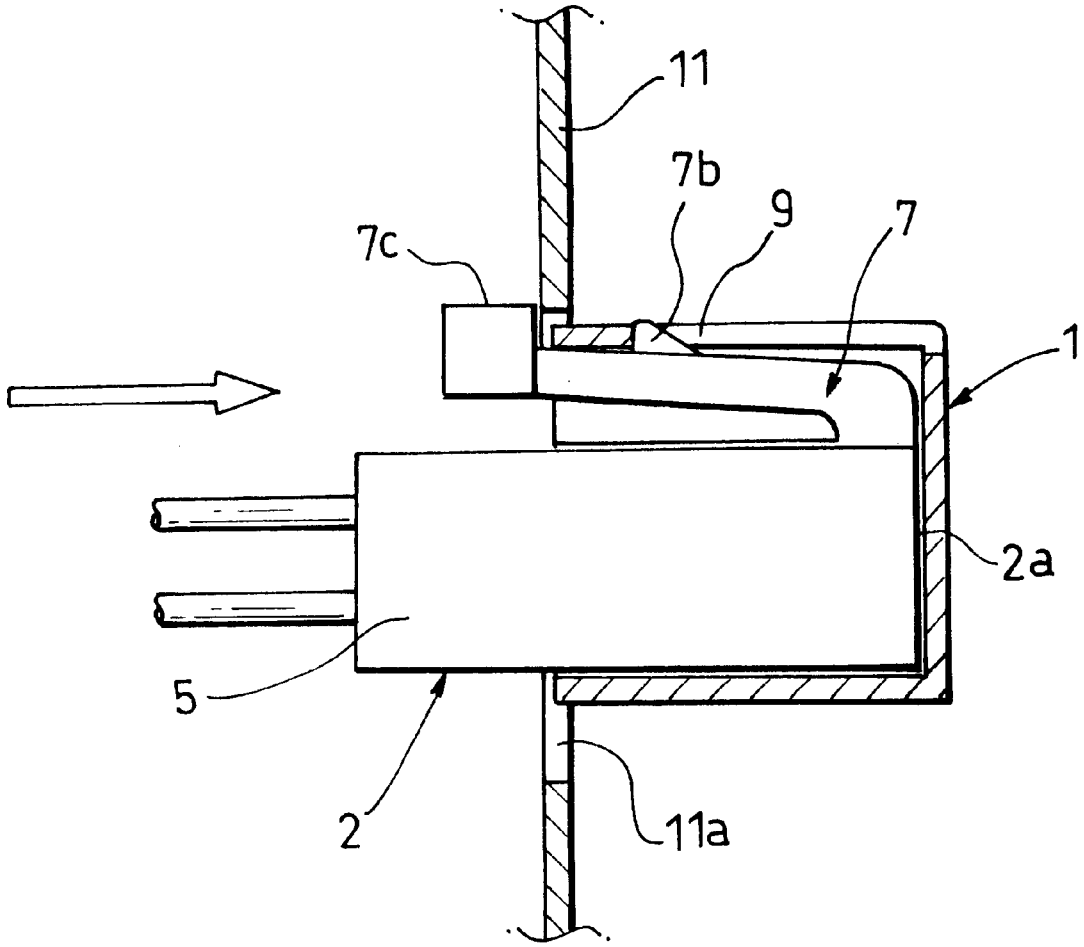
FIG. 6 PRIOR ART
FIG. 6 is a cross-sectional view illustrating a state during an operation of inserting the connector, with the protective cover shown in FIG. 5 fitted thereon, into a panel.
Figure 7:
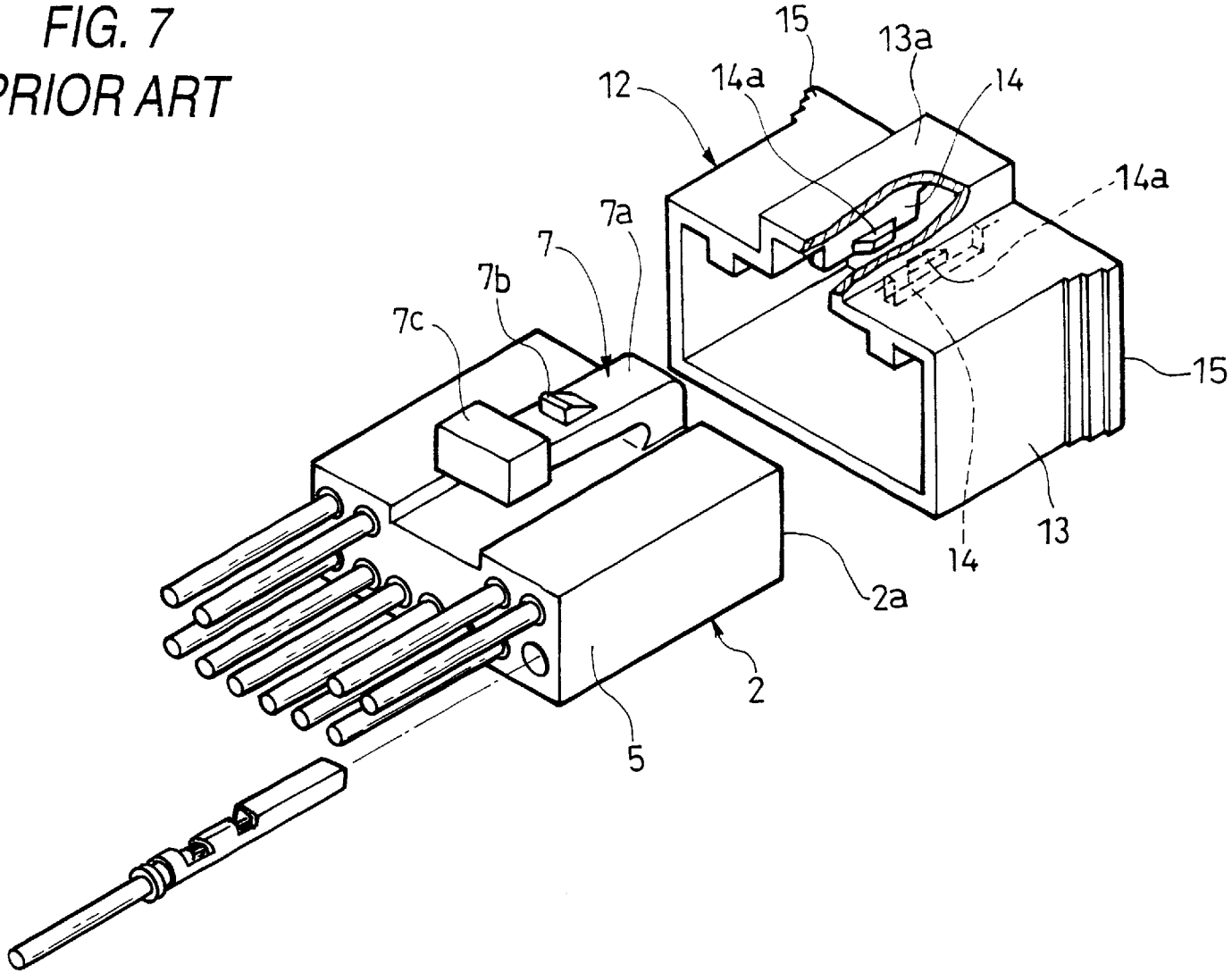
FIG. 7 PRIOR ART
FIG. 7 is a fragmentary perspective view illustrating a state in which another conventional protective cover for a connector is removed from a connector.
Figure 8:
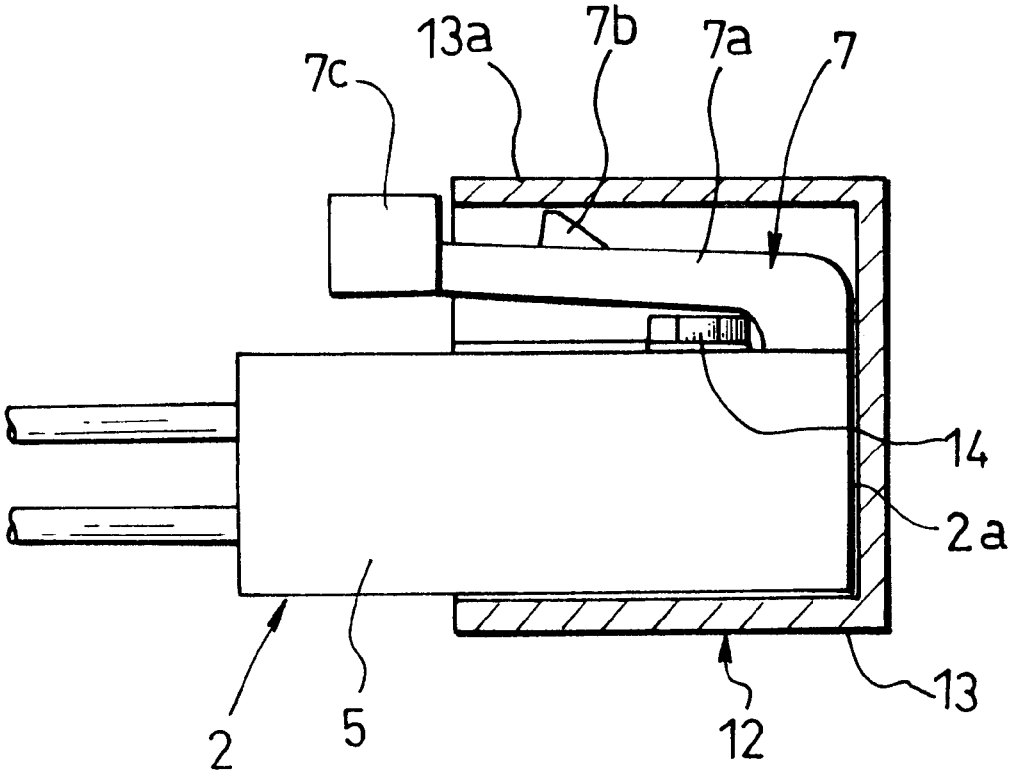
FIG. 8 PRIOR ART
FIG. 8 is a vertical cross-sectional view illustrating a state in which the protective cover shown in FIG. 7 is fitted over the connector.

As shown in FIG. 4, as for the pair of arm protecting walls 32, the height of an upper edge 32*a* of each arm protecting wall 32 is set in such a way that the lock arm 26 is accommodated in a space defined by the pair of arm protecting walls 32 (i.e., in such a way that the upper edge 32*a* of each arm protecting wall 32 projects an appropriate dimension L outwardly of the tab portion 26*c* located at a most outward position in the lock arm 26). Incidentally, the dimension L of projection is sufficient if it is 0 or more.

In addition, the upper edges 32*a* of the pair of arm protecting walls 32 are sloped in such a manner that their height becomes higher from the front end side of the terminal engaging portion 21*a* of the connector 21, which is fitted to the protective cover 20, toward the rear end side of the connector (from the left end side toward the right end side in FIG. 4).

It should be noted that, in the case of the protective cover 20 of this embodiment, one pair of engaging projections 30 are provided by being spaced apart in the widthwise direction, but the one located on the left-hand side in FIG. 1 is used in the engagement with the connector 21. The right-hand engaging projection 30 is provided to correspond to a different connector in which the projecting position of the lock arm differs.

Namely, according to the protective cover 20 of this embodiment, when the protective cover 20 is fitted over the connector 21, the engagement and disengagement between the engaging projection 30 on the cover body 29 and the engaging stepped portion 26*b* on the lock arm 26 can be easily attained by the tilting operation of the lock arm 26 of the connector 21, and it is unnecessary to forcibly press or pull the protective cover 20 with respect to the connector 21 for the engagement or disengagement. Accordingly, a large force is not required for the engaging or disengaging operation, and the engagement or disengagement with respect to the connector 21 can be easily effected, so that the operating efficiency in fitting or removing the protective cover 20 with respect to the connector does not decline.

In addition, the pair of arm protecting walls 32 provided projectingly on the outer peripheral wall of the cover body 29 project outwardly of the lock arm 26 of the connector 21 over which the protective cover 20 is fitted, and another member or the like is prevented from striking on the lock arm 26. Therefore, it is possible to prevent a situation where another member or the like strikes on the tab portion 26*c* of the flexible arm 26 during storage or installing operation of the connector 21, causing the lock arm 26 to tilt. For this reason, it is possible to reliably prevent the protective cover 20 from coming off the connector 21 unintentionally during storage or installing operation, and it is possible to prevent the permanent set of the lock arm 26.

Moreover, since the pair of arm protecting walls 32 are provided projectingly on the outer surface of the outer peripheral wall of the cover body 29, it is possible to prevent a situation in which a mold of the protective cover 20 becomes complex, resulting in higher cost.

In addition, since the upper edges 32*a* of the pair of arm protecting walls 32 are sloped in such a manner that their height becomes higher from the terminal engaging portion 21*a* of the connector 21, which is fitted to the protective cover 20, toward the rear end side of the connector, when the connector 21 with the protective cover 20 fitted thereon is inserted in a connector insertion hole 11*a* formed in an instrument panel 11, the upper edges 32*a* of the arm protecting walls 32 serve as inserting guides and make it possible to enhance the insertability. It goes without saying that the tab portion 26*c* is prevented from being caught at the opening edge of the connector insertion hole 11*a*.

It should be noted that the arrangements of the cover body, the retaining means, and the arm protecting walls are not limited to those of the above-described embodiment, and it goes without saying that various modifications are possible within the scope of the present invention. For example, in a case where the engaging portion formed on the lock arm is an engaging projection, the retaining means provided in the cover body of the protective cover is formed as a retaining hole.

In addition, the mating connector which is fitted is not limited to the arrangement of the connector 21, and the protective cover can be used for various connectors insofar as they are connectors in which the lock arm is provided projectingly on the outer peripheral wall of the housing.

What is claimed is:

1. A protective cover for a connector for protecting a terminal engaging portion of the connector in which a lock arm for retaining a connector engaging portion on a mating side is provided projectingly on an outer peripheral wall of a housing, said protective cover comprising:

a cover body to be fitted over the terminal engaging portion of the connector;

a retaining device provided on said cover body in such a manner as to be capable of engaging an engaging portion formed on the lock arm and of being disengaged from the engaging portion by a tilting operation of the lock arm; and a pair of arm protecting walls provided projectingly on an outer peripheral wall of said cover body in such a manner as to face each other with the lock arm positioned therebetween, wherein a height of an upper edge of each of said arm protecting walls is set in such a manner to be higher than a height of an upper edge of said lock arm.

2. The protective cover according to claim 1, wherein the upper edge of each of said arm protecting walls is sloped in such a manner that its height becomes higher from a front end side of the terminal engaging portion of the connector, which is fitted to said protective cover, toward a rear end side of the connector.

3. The protective cover according to claim 1, wherein a plurality of retaining devices are formed on said cover body to accommodate connectors having different lock-arm projecting positions.

* * * * *